US007753606B2

(12) United States Patent
Maekawa

(10) Patent No.: US 7,753,606 B2
(45) Date of Patent: Jul. 13, 2010

(54) ROLL PAPER PRINTER WITH POSITIONING MEMBERS

(75) Inventor: Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 470 days.

(21) Appl. No.: 11/807,844

(22) Filed: May 30, 2007

(65) Prior Publication Data

US 2007/0237563 A1 Oct. 11, 2007

(30) Foreign Application Priority Data

May 31, 2006 (JP) ..... 2006-151417

(51) Int. Cl.
*B41J 15/04* (2006.01)

(52) U.S. Cl. ..... 400/613; 400/619

(58) Field of Classification Search ..... 400/613
See application file for complete search history.

(56) References Cited

U.S. PATENT DOCUMENTS

| | | | | |
|---|---|---|---|---|
| 4,179,077 | A * | 12/1979 | Morishita | 242/423 |
| 5,860,753 | A * | 1/1999 | Beck et al. | 400/692 |
| 6,584,896 | B1 * | 7/2003 | Kashiwaba et al. | 400/613 |
| 6,698,959 | B2 * | 3/2004 | Kaya | 400/613 |
| 6,837,634 | B2 * | 1/2005 | Huggins et al. | 400/613 |
| 2005/0002721 | A1 * | 1/2005 | Koyabu | 400/613 |
| 2005/0232677 | A1 | 10/2005 | Ogawa et al. | |

FOREIGN PATENT DOCUMENTS

| | | |
|---|---|---|
| JP | 08-133540 | 5/1996 |
| JP | 09-255196 | 9/1997 |
| JP | 11-246084 | 9/1999 |
| JP | 2006-062827 | 9/2006 |

* cited by examiner

*Primary Examiner*—Jill E Culler

(57) ABSTRACT

A roll paper printer having a roll paper compartment in which roll paper is mounted so that the roll paper is freely rotatable inside the roll paper compartment with the roll paper compartment designed to prevent the roll paper from meandering from a given path of travel along which the paper roll is unwound. The design of the compartment prevents the edges of the paper from catching on steps between pairs of roll paper guides connected to or forming the sides of the roll paper compartment. Movable roll paper positioning plates 31 and 32 are urged toward each other by a tension spring 37 in the roll paper compartment 9 of the printer 1 located near the top of one pair of roll paper guides 28 and 29. The movable roll paper positioning plates 31 and 32 have roll paper positioning surfaces 31*a* and 32*a* which can contact the outside circumference part of the ends 10*b* and 10*c* of the roll paper 10. If the paper 10*a* shifts sideways when the paper 10*a* is pulled off the roll paper 10, the paper 10*a* contacts the roll paper positioning surfaces 31*a* and 32*a* but the force of the tension spring 37 prevents the paper 10*a* from shifting widthwise to the transportation direction and prevents the paper 10*a* from becoming biased to the transportation path.

13 Claims, 7 Drawing Sheets

ROLL PAPER PRINTER WITH POSITIONING MEMBERS

The entire disclosure of Japanese Patent Application No. 2006-151417, filed May 31, 2006 is expressly incorporated by reference herein.

BACKGROUND OF THE INVENTION

1. Technical Field

The present invention relates to a roll paper printer that prints on a paper web delivered from a roll of paper held freely rotatably inside a roll paper compartment, and relates more particularly to technology for preventing problems caused by the leading end portion of the roll paper unwinding in the transportation direction inside the roll paper compartment and then shifting sideways.

2. Related Art

Roll paper printers print to a paper web that is pulled from a roll of paper held freely rotatably inside a roll paper compartment. Due to the inertia of the paper roll when the paper is pulled from the roll, the portion of paper that is wound at the outside circumference of the roll may unwind and be left in a slack loop inside the roll paper compartment.

When the side walls of the roll paper compartment are simple flat guide surfaces (roll paper guides) located a specific distance apart, the unwound portion at the outside circumference side of the paper roll may shift widthwise and become angled to the normal transportation direction. Even when the side walls of the roll paper compartment are rendered using a plurality of guide surfaces instead of by simple flat guide surfaces, the slack unwound portion at the outside circumference of the paper roll may shift widthwise and become angled to the normal transportation direction. This can cause such problems as the edges of the roll paper catching on the edge of the guide surface or the edges being folded over as the paper is delivered from the roll paper compartment.

To avoid such problems when the sides of the roll paper compartment are defined by a plurality of roll paper guides, the distance between the left and right roll paper guides disposed along the direction in which the roll paper rotates (that is, disposed substantially parallel to the direction in which the roll paper is conveyed) gradually narrows from the upstream side to the downstream side in the direction of roll paper rotation so that the gap between the pair of roll paper guides located at the most downstream end near the printing position is narrowest. Narrowing the gap between the pair of roll paper guides along the transportation direction of the roll paper thus gradually limits the widthwise movement of the roll paper as the paper is conveyed downstream.

However, because the widthwise movement of the roll paper is only loosely limited in the area where the gap between the roll paper guides is wide on the upstream end of the transportation path, the paper can still shift sideways if the outside circumference part of the roll paper unwinds and goes slack in this area. Furthermore, once the paper shifts widthwise in this area, the paper will be fed biased to the transportation direction from the pair of upstream roll paper guides where the gap is wide to the pair of downstream paper guides where the gap is narrow.

Because a plurality of roll paper guide pairs are disposed between the roll paper guide pair with the widest gap and the roll paper guide pair with the narrowest gap, plural steps protrude to the inside widthwise to the roll paper compartment when seen from the downstream side of the paper transportation direction. As a result, if the paper is advanced biased to the transportation direction, the edge part of the paper that is pushed to one side widthwise to the transportation direction may catch on these steps. The edge part of the paper that is thus caught by these steps is easily folded over and may be conveyed downstream with a crease along the edge. Such creasing occurs particularly easily with thin paper that is not stiff.

One common method of controlling the widthwise position of the paper delivered from the roll is therefore to use a single-sided guide, that is, a guide surface along one lengthwise edge of the paper. If this single-sided guide is rendered using a plurality of roll paper guides, the roll paper guides will be disposed in steps along the paper transportation direction. As a result, if the paper becomes biased to the transportation direction, the edge of the paper will still catch on the steps and be folded over.

Japanese Unexamined Patent Appl. Pub. JP-A-H08-133540 and Japanese Unexamined Patent Appl. Pub. JP-A-H09-255196 teach arrangements for preventing the paper becoming biased to the transportation direction as the paper is delivered from the paper roll.

More specifically, Japanese Unexamined Patent Appl. Pub. JP-A-H08-133540 teaches using a flat guide surface rendered by a single-member paper guide in order to regulate widthwise movement of roll paper or other print medium supplied in a roll.

Japanese Unexamined Patent Appl. Pub. JP-A-H09-255196 teaches using a substantially U-shaped frame (having a pair of side guide members and a bottom contact member) that is placed from above onto the paper roll and can rock freely vertically to prevent the portion of the roll paper that is pulled off the roll from shifting sideways.

A problem with the arrangement described in Japanese Unexamined Patent Appl. Pub. JP-A-H08-133540 is that using a paper guide on only one side cannot prevent the paper from becoming biased to the transportation direction.

The arrangement taught in Japanese Unexamined Patent Appl. Pub. JP-A-H09-255196 uses a substantially U-shaped frame. In a compact roll paper printer, however, providing enough space to locate a frame that is large enough to place over the roll from above is difficult. In addition, placing such a frame over the roll increases friction and resistance to pulling the paper from the paper roll. Resistance to roll paper transportation also varies as the diameter of the paper roll increases. As a result, the rate at which the paper is delivered from the roll may also vary.

SUMMARY

The present invention is directed to a roll paper printer that has a simple arrangement for preventing the paper from becoming biased to the transportation direction and for preventing the paper from becoming caught between the plural roll paper guides that define the sides of the roll paper compartment without creating resistance to roll paper transportation.

A roll paper printer according to a preferred aspect of the invention has a print head; a roll paper compartment; first and second positioning members disposed at positions where the first and second positioning members can contact or oppose the outside circumference parts of the opposite ends (sides) of a paper roll held in the roll paper compartment; and an urging member that urges the first and second positioning members together from the outside to the opposite ends of the paper roll. The roll paper is held in the roll paper compartment so that the roll paper can rotate freely on the bottom of the roll paper compartment.

The opposite sides of the roll paper compartment are defined by a plurality of roll paper guide pairs, and the gaps between the roll paper guide pairs narrow in steps approaching the print head position (the printing position) when viewed in the direction of roll paper rotation. The first and second positioning members are disposed movably widthwise to the roll paper compartment, and are located beside the roll paper guide pair that is farthest from the printing position when seen in the direction of roll paper rotation. Adjacent roll paper guide pairs are thus stepped widthwise to the roll paper compartment.

When roll paper is stored in the roll paper compartment, the first and second positioning members located beside the roll paper guide pair at the upstream end of the transportation direction where the gap between the roll paper guide pair is greatest contact or oppose with a slight gap the outside circumference part of the roll paper from the opposite ends (sides) of the paper roll. When paper is pulled from the paper roll toward the printing position at the downstream end of the transportation direction, the paper roll rotates as the paper is pulled off and the part at the outside circumference of the roll may unwind and become slack inside the roll paper compartment. The slack part of the paper at the outside circumference of the roll where the sideways position of the paper is regulated by the roll paper guide pair disposed with the widest gap is particularly susceptible to shifting sideways.

However, because the first and second positioning members of the invention are disposed contacting or with a slight gap to the outside circumference part of the opposite ends (sides) of the roll, an edge part at the outside circumference side of the paper roll contacts the first or second positioning member when the paper shifts sideways, and sideways shifting is thus prevented or suppressed. As a result, problems caused by the paper pulled off the roll shifting or meandering, such as the edges of the paper catching and being folded by the steps between adjacent roll paper guide pairs, can be prevented. The roll paper can also be easily replaced because the roll paper is loaded resting on the bottom of the roll paper compartment.

The first and second positioning members are disposed movably widthwise to the roll paper compartment, and are urged to the inside by an urging member. As a result, when an edge part at the outside circumference side of the paper roll contacts the first or second positioning member, the positioning member retracts and the roll paper transportation load is reduced. This prevents problems caused by the transportation load of the roll paper increasing, such as it becoming unable to advance the paper with good precision.

When a new roll of paper is loaded the diameter of the roll paper is large, the inertia of the roll is therefore great, and slack tends to develop easily at the outside circumference part of the roll. The positioning members of this invention are therefore positioned to contact or oppose with a slight gap the opposite ends (sides) of the outside circumference part of the paper roll held in the roll paper compartment. These positioning members can therefore be small, require little installation space, and can be provided at little cost.

The first and second positioning members are further located at a position that is separated from the paper roll when the diameter of the paper roll is small. Because the outside circumference part of the roll paper does not tend to become slack when the roll paper is consumed and the outside diameter is reduced to near the core of the roll, positioning the roll paper by means of the first and second positioning members is unnecessary.

If the urging member is a coil tension spring connected between the first and second positioning members, both positioning members can be urged using a single urging member. The positioning members therefore move together substantially the same distance in the same direction, the distance between the members remains substantially constant, and the position of the outside circumference part of the roll paper can be effectively prevented from shifting.

Roll paper guide surfaces for guiding the paper roll between the first and second positioning members are preferably formed on the first and second positioning members so that when the roll paper is loaded into the roll paper compartment the roll paper can be easily positioned between the first and second positioning members disposed with a narrow gap therebetween.

The roll paper printer preferably also has an openable cover for opening and closing a roll paper loading opening to the roll paper compartment, and the urging member, the first and second positioning members, and the roll paper guide pair that is farthest from the print head position when seen in the direction of roll paper rotation are disposed to the openable cover.

In a roll paper printer according to the present invention first and second positioning members are disposed inside the roll paper compartment near the part where the sides of the compartment are defined by the roll paper guide pair disposed with the widest gap, the first and second positioning members are positioned to contact or oppose the outside circumference part of the opposite ends (sides) of the paper roll, and an urging member urges the first and second positioning members together to the inside of the roll paper compartment. These positioning members thus prevent the paper pulled off the paper roll from shifting sideways. Problems caused by the paper pulled off the roll becoming biased to the transportation direction, such as the edges of the paper catching on or being folded by the steps between adjacent roll paper guide pairs, can thus be avoided.

Because these positioning members prevent the paper from shifting sideways, the precision required in the manufacture and assembly of the roll paper guide pairs is reduced and the gaps between the roll paper guide pairs can be easily adjusted.

In addition, less space is required to install the positioning members because the positioning members provided inside the roll paper compartment only need to be large enough to contact the outside circumference part of the ends of the paper roll. Such problems as being unable to provide sufficient installation space or needing to increase the size of the roll paper compartment in order to provide sufficient installation space are thus prevented.

Furthermore, because simple positioning members that are urged by an urging member can be used, the mechanism for preventing or suppressing biasing of the paper can be rendered simply and inexpensively, and the cost increase in the roll paper printer can be minimized.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a roll paper printer according to the present invention is described below with reference to the accompanying FIGS. 1-7 respectively.

Figure 1:
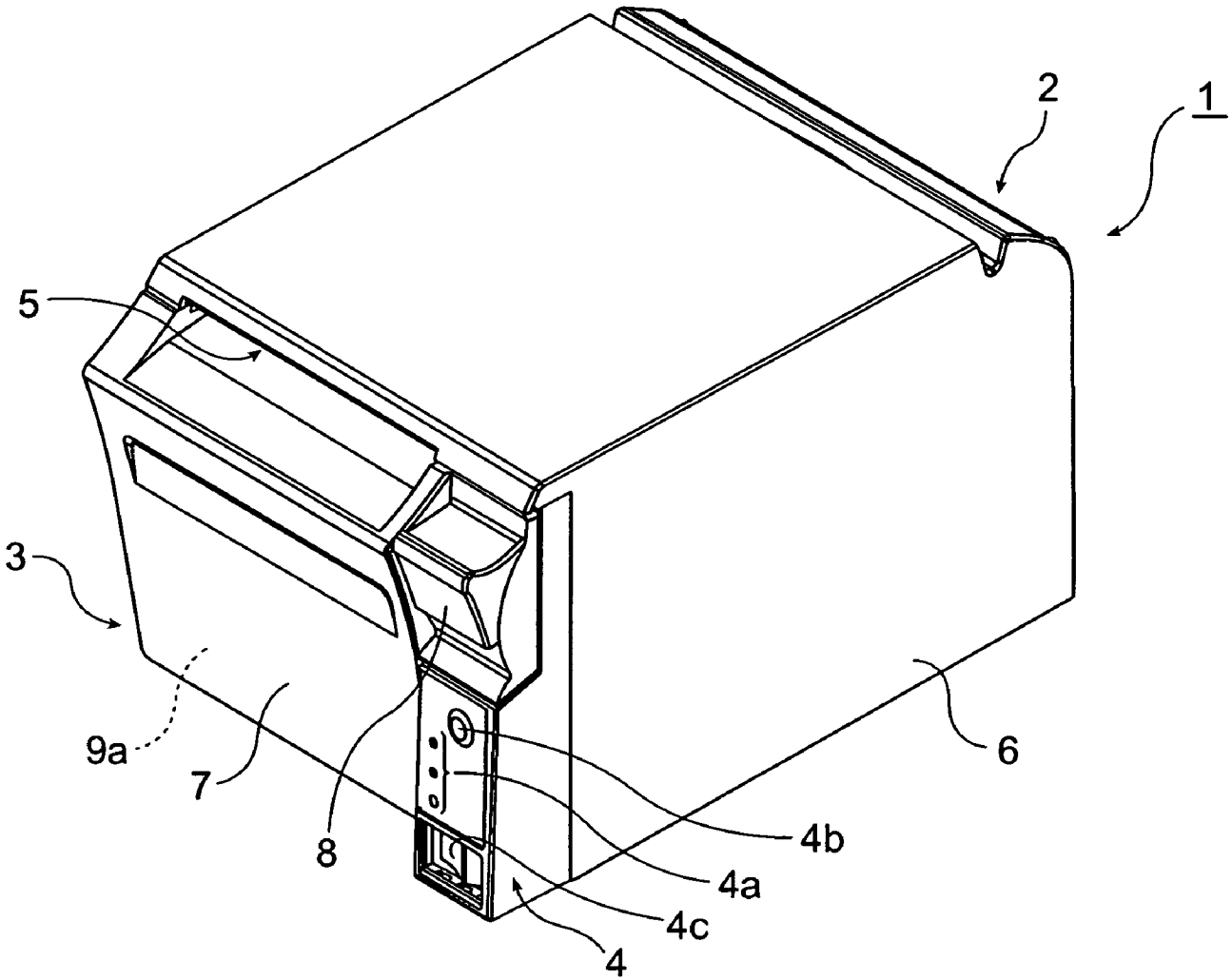
FIG. 1 is an external oblique view of a roll paper printer according to the present invention.

As shown in FIG. 1 the roll paper printer 1 has a printer body 2 and an openable cover unit 3 that is attached to open and close at the front of the printer body 2. An operating panel unit 4 is disposed at a front corner of the printer body 2. A paper exit 5 is formed as a slot extending widthwise to the roll paper printer 1 at the top front part of the openable cover unit 3 at the front of the roll paper printer 1.

The printer body 2 is covered by a box-shaped main case 6 which is longer front to back than widthwise and may be opened from the front. An openable cover case 7 that defines the front of the roll paper printer 1 is attached at the front of the openable cover unit 3. When an operating lever 8 that is disposed near the operating panel unit 4 is operated, a cover lock not shown is released and the openable cover unit 3 can swing forward and open pivoting at the bottom end of the openable cover unit 3. Opening the openable cover unit 3 opens the roll paper loading opening 9*a* in front of the roll paper compartment 9, which is rendered inside the printer, so that the roll paper 10 can be loaded or replaced. An operating state indicator group 4*a* of typically LEDs, a feed button 4*b*, and a power switch 4*c* are disposed on the front of the operating panel unit 4.

Figure 2:
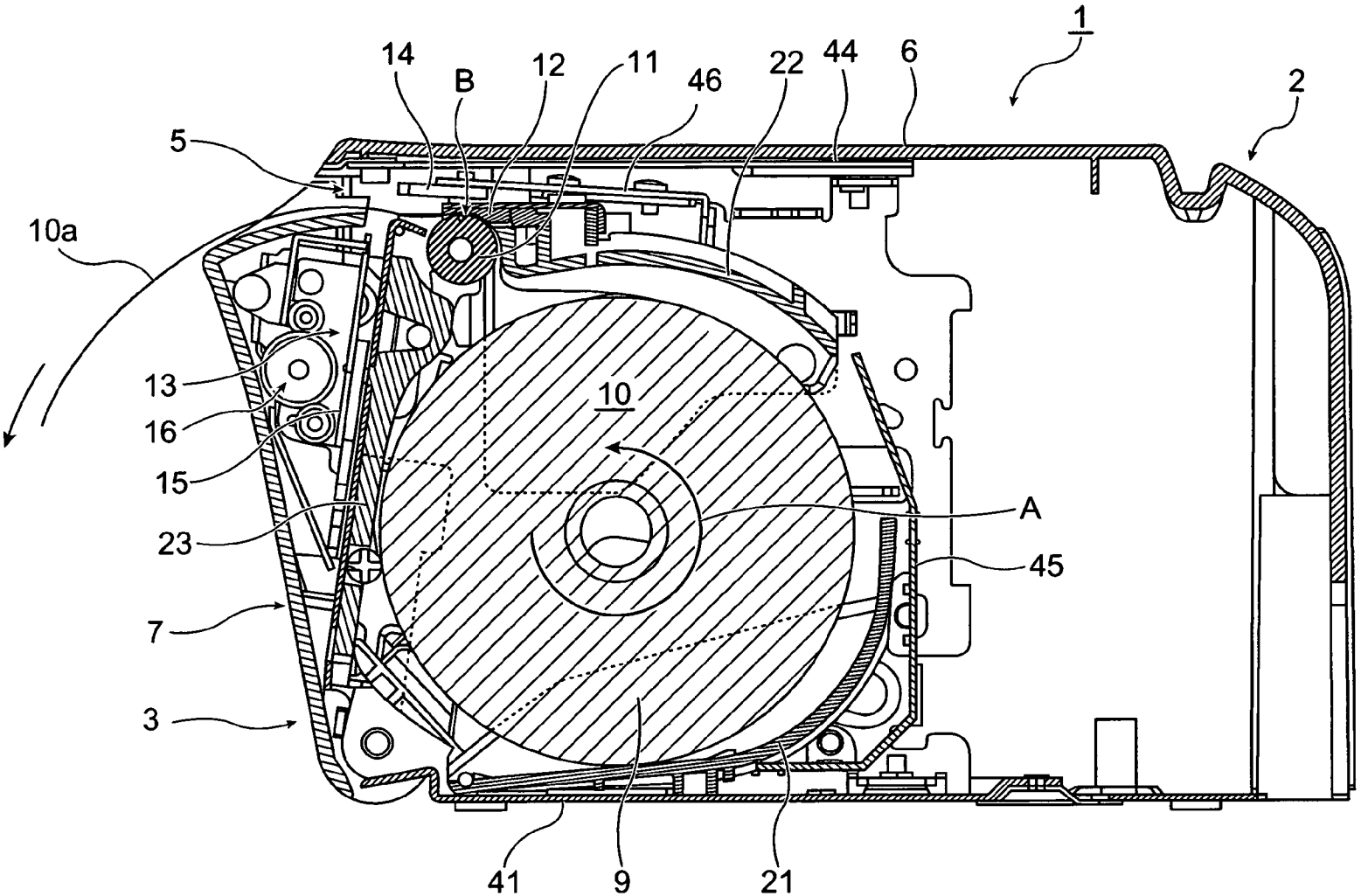
FIG. 2 is a schematic view showing the internal arrangement of the roll paper printer of the invention.

As shown in FIG. 2, the roll paper 10 is held freely rotatably inside the roll paper compartment 9. A platen roller 11 is disposed at a position at the top front side of the roll paper compartment 9, a thermal print head 12 is located near the top of the printer body 2 substantially above the platen roller 11, and the platen roller 11 is pushed from below against the printing surface of the thermal print head 12. Rotation of the platen roller 11 causes the roll paper 10 held inside the roll paper compartment 9 to rotate in the direction of arrow A which unwinds the leading end 10*a* of the roll paper 10 and moves the end passed the printing position B of the thermal print head 12 for printing. The roll paper is discharged from the paper exit 5 located downstream from the printing position.

A scissor-type paper cutter 13 is located before the paper exit 5. The paper cutter 13 has a fixed blade 14 disposed on the printer body 2 side, and a movable blade 15 and movable blade drive mechanism 16 disposed on the openable cover unit 3 side. Causing the movable blade 15 disposed on the bottom side of the paper path to pivot upward cuts across the width of the paper 10*a*.

Figure 3:
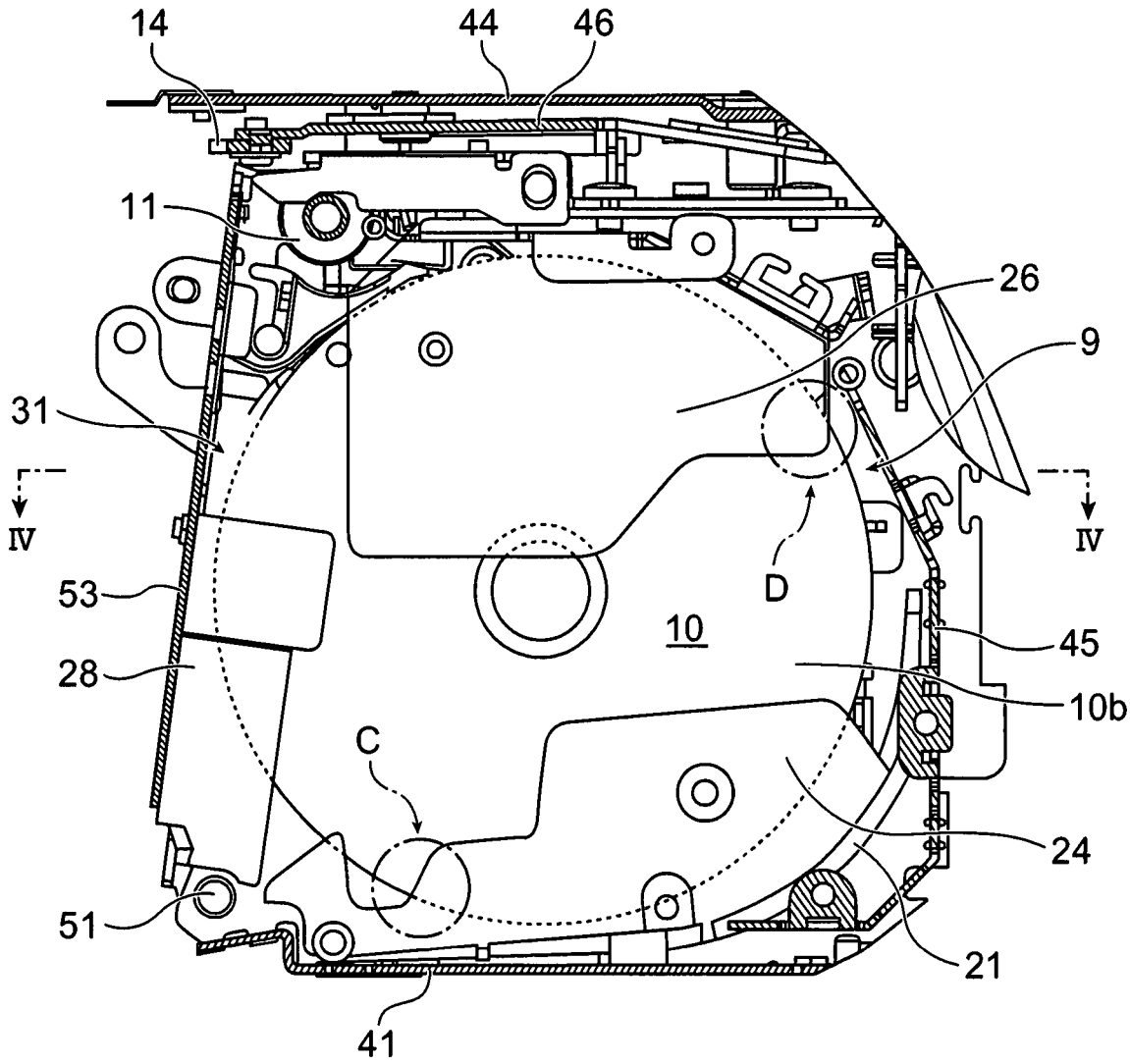
FIG. 3 is a partial schematic side view showing the roll paper compartment.
Figure 4:
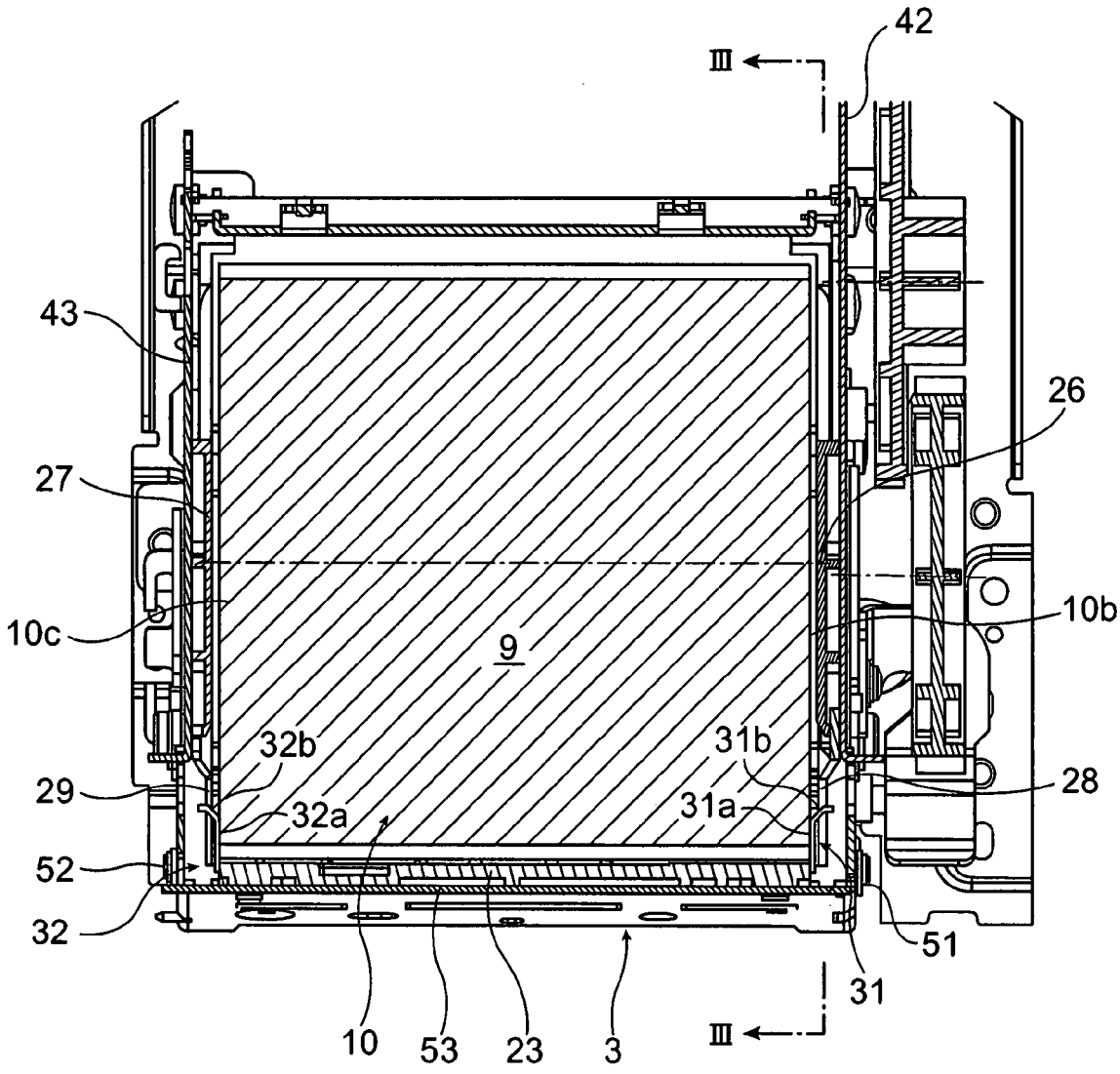
FIG. 4 is a schematic section view through imaginary line IV in FIG. 3.

FIG. 3 is a partial schematic side view of the roll paper compartment 9, and FIG. 4 is a schematic section view of the roll paper compartment 9 through imaginary line IV in FIG. 3. Referring to FIG. 2 to FIG. 4, the roll paper compartment 9 formed inside the roll paper printer 1 is enclosed by a bottom panel 21 that extends widthwise to the roll paper printer 1 and curves to conform to the outside circumference of the roll paper 10, a similarly curved top panel 22 that also extends widthwise to the roll paper printer 1, and a front panel 23 that also extends widthwise to the roll paper printer 1.

Roll paper guides 24 and 25 (only roll paper guide 24 is shown in FIG. 3) are disposed on opposite sides of the bottom panel 21. Roll paper guides 26 and 27 (only roll paper guide 26 is shown in FIG. 3) are similarly disposed on opposite sides of the top panel 22. Roll paper guides 28 and 29 (only roll paper guide 28 is shown in FIG. 3) are similarly disposed on opposite sides of the front panel 23. These roll paper guides 24 to 29 form the sides of the roll paper compartment 9.

As shown in FIG. 4, roll paper positioning plates 31 and 32 (first and second positioning members) are disposed above near the roll paper guides 28 and 29. The roll paper positioning plates 31 and 32 have straight roll paper positioning surfaces 31*a* and 32*a* and roll paper guide surfaces 31*b* and 32*b*, respectively. The roll paper positioning surfaces 31*a* and 32*a* extend in the front-to-back direction of the printer 1, and the roll paper guide surfaces 31*b* and 32*b* angle from the back ends of the roll paper positioning surfaces 31*a* and 32*a* to the outside widthwise to the printer 1. As will be known from FIG. 4, the roll paper positioning surfaces 31*a* and 32*a* of the roll paper positioning plates 31 and 32 are positioned at the outside circumference part of the roll paper 10 so that the opposite end sides 10*b* and 10*c* of the roll paper 10 are between the roll paper positioning surfaces 31*a* and 32*a*. As a result, the ends 10*b* and 10*c* of the roll paper 10 at the outside circumference part of the roll separate from the roll paper positioning surfaces 31*a* and 32*a* as the roll paper 10 is consumed and the roll diameter decreases.

Figure 5:
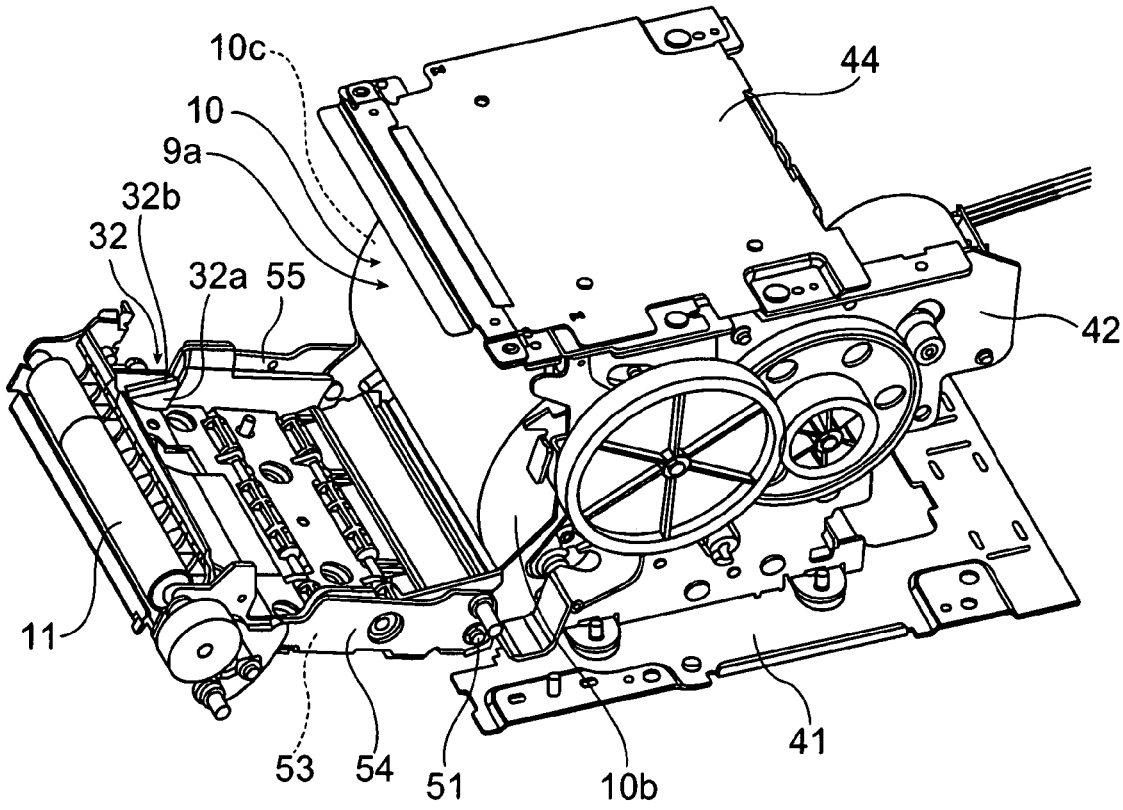
FIG. 5 is an oblique view of the printing mechanism.

FIG. 5 is an oblique view showing the printing mechanism (the printer body 2 and the openable cover unit 3) that is covered by the main case 6 and the cover case 7 of the roll paper printer 1 when the openable cover unit 3 is open.

Referring also to FIG. 5, the printer body 2 includes a base panel 41, right and left side panels 42 and 43 rising vertically from the base panel 41, a top panel 44, and a back panel 45 extending widthwise to the printer 1 between the bottom back parts of the right and left side panels 42 and 43. A print head installation panel 46 extends horizontally widthwise to the printer 1 below the top panel 44. The thermal print head 12 is attached to the bottom of this print head installation panel 46 with the print surface facing down. The top panel 22 of the roll paper compartment 9 is disposed at the back below the print head installation panel 46. The bottom panel 21 of the roll paper compartment 9 is disposed to the top of the base panel 41. The fixed blade 14 of the paper cutter 13 is attached facing forward and substantially horizontally at the bottom front edge part of the print head installation panel 46.

The openable cover unit 3 can swing open a specific angle to the front of the printer 1 pivoting on support pins 51 and 52. The support pins 51 and 52 are attached at the bottom end part of the side panels 42 and 43 of the printer body 2. The openable cover unit 3 has a front panel part 53, and narrow side panel parts 54 and 55 that are bent substantially perpendicularly to the back from opposite sides of the front panel part 53. The movable blade 15 and the movable blade drive mechanism 16 of the paper cutter 13 are affixed to the front of the front panel part 53 and are covered by the cover case 7. The platen roller 11 is disposed freely rotatably between the top end parts of the side panel parts 54 and 55 of the openable cover unit 3.

The front panel 23 of the roll paper compartment 9 is attached to the front panel part 53. The roll paper positioning plates 31 and 32 are also attached to the front panel part 53. The roll paper guides 28 and 29 are disposed between the side panel parts 54 and 55.

The front panel 23 of the roll paper compartment 9, the platen roller 11, and the movable blade 15 and movable blade drive mechanism 16 of the paper cutter 13 are thus mounted on the openable cover unit 3. When the openable cover unit 3 is closed, a paper 10*a* transportation path is formed from the roll paper compartment 9 passed the printing position B and the paper cutting position to the paper exit 5 as shown in FIG. 2. When the openable cover unit 3 is open, the roll paper loading opening 9*a* to the roll paper compartment 9 is open and the paper transportation path is open as shown in FIG. 5. As a result, if the openable cover unit 3 is closed with paper 10*a* pulled out from the roll paper 10 inside the roll paper compartment 9, the paper 10*a* is automatically threaded through the paper transportation path.

Roll Paper Positioning Plates

Figure 6A:
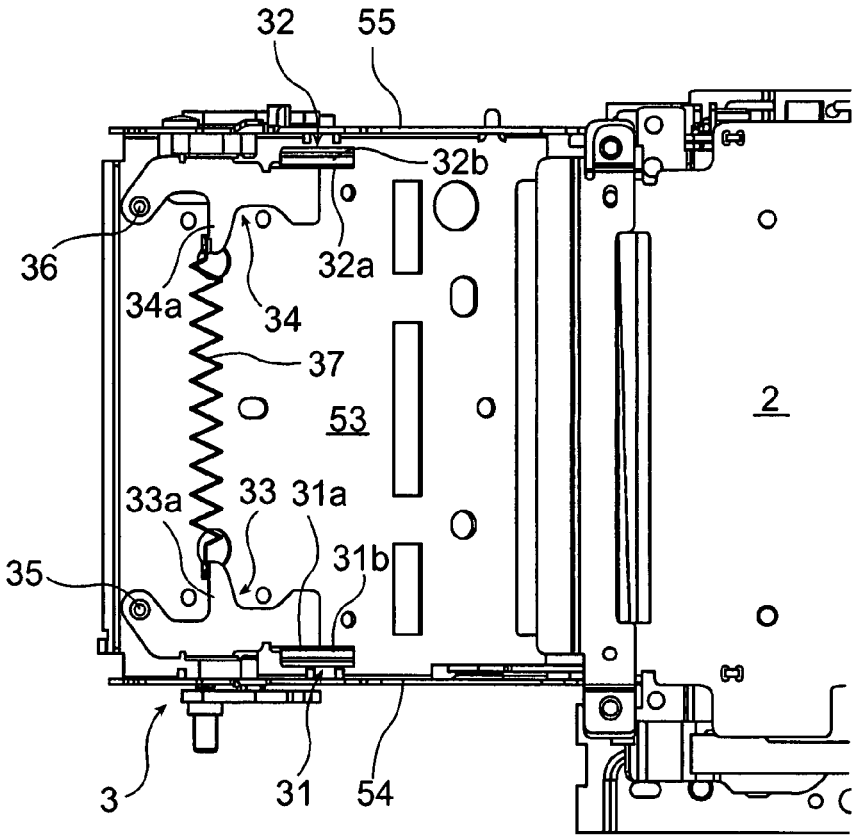
FIG. 6A and FIG. 6B show where the roll paper positioning plates are attached to the openable cover unit.
Figure 6B:
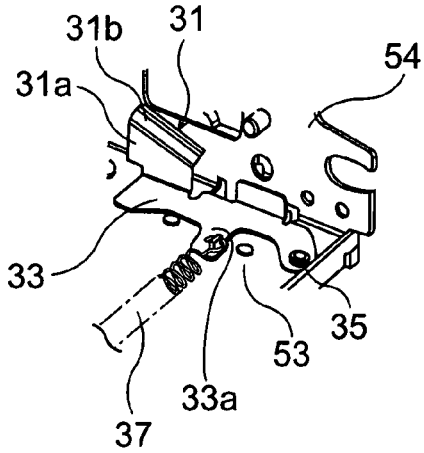

FIG. 6A and FIG. 6B show where the roll paper positioning plates 31 and 32 are attached to the openable cover unit 3. The right and left roll paper positioning plates 31 and 32 are symmetrical to each other. Each roll paper positioning plate 31 and 32 has a rocker plate 33, 34 formed integrally to its bottom end, and the rocker plates 33 and 34 are parallel to the front panel part 53 of the openable cover unit 3. The rocker plates 33 and 34 are also symmetrical to each other, and are attached to the front panel part 53 freely pivotably widthwise to the printer 1 on support pins 35 and 36 that are fixed to the opposite top side parts of the front panel part 53.

The rocker plates 33 and 34 each have an arm portion 33*a* and 34*a*, respectively, projecting to the inside widthwise to the printer 1, and a tension spring 37 (a urging member) extending widthwise to the printer 1 is connected between the arm portion 33*a* and 34*a*. The roll paper positioning plates 31 and 32 are formed integrally to the rocker plates 33 and 34 at the end part opposite the ends on which the rocker plates 33 and 34 pivot. The roll paper positioning plates 31 and 32 can thus move widthwise to the printer 1 pivoting on the support pins 35 and 36. When no load is applied, the tension spring 37 maintains a specific gap between the roll paper positioning surfaces 31*a* and 32*a*.

Figure 7B:
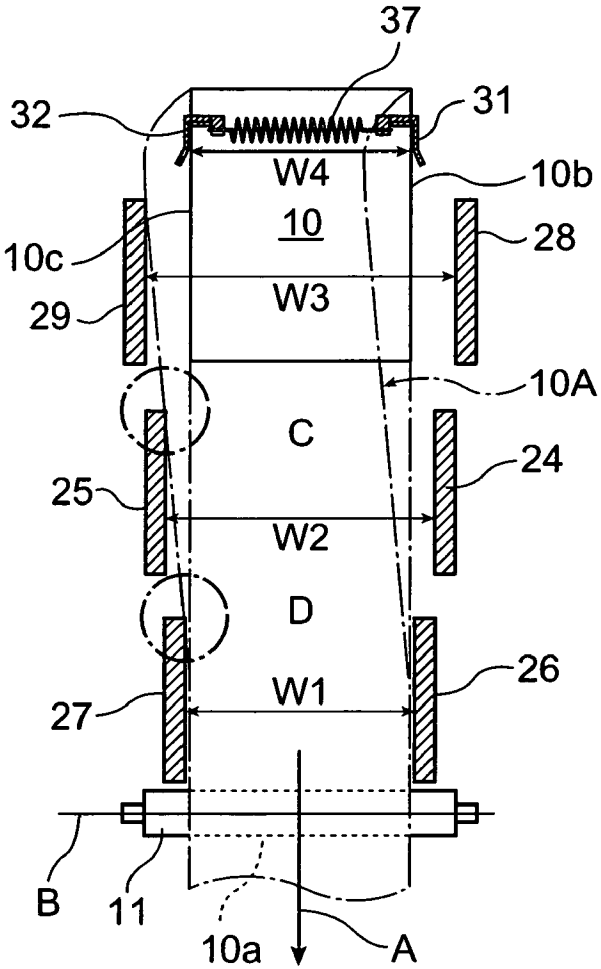
FIG. 7A and FIG. 7B describe the roll paper positioning operation of the roll paper positioning plates.
Figure 7A:
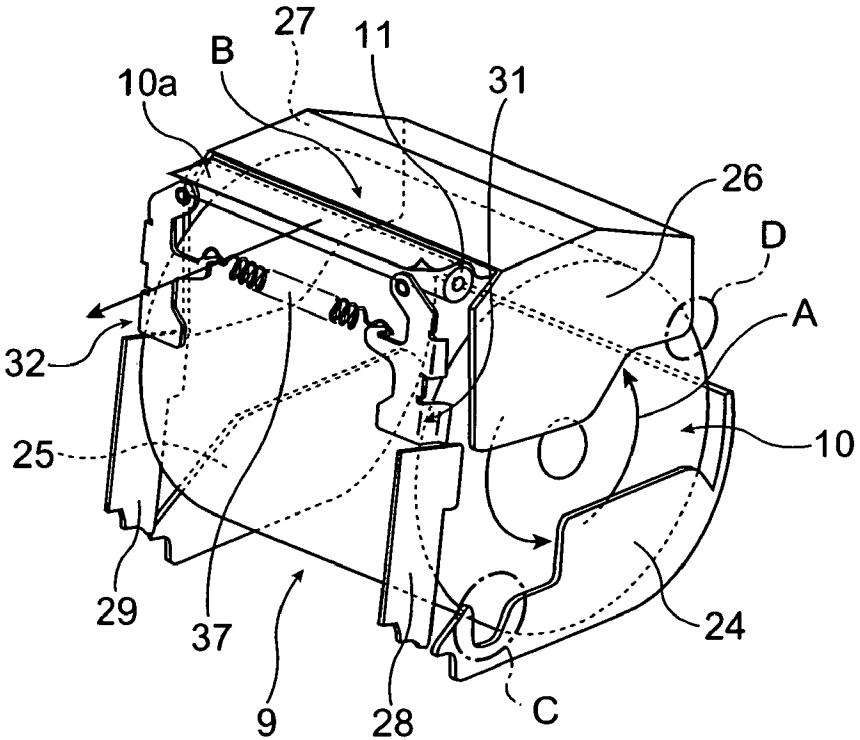

FIG. 7A and FIG. 7B describe the relative positions of the roll paper guides 24 to 29 of the roll paper compartment 9 and the roll paper positioning plates 31 and 32.

When viewed in the direction A of roll paper 10 rotation, the roll paper guides 28 and 29 at the front panel side on the upstream end of the paper transportation path are farthest from the printing position B, the roll paper guides 26 and 27 on the top panel side at the downstream end of the paper transportation path are nearest the printing position B, and the roll paper guides 24 and 25 at the bottom panel side are between the end roll paper guides 27 to 29. The gap W1 between the roll paper guides 26 and 27 nearest the printing position B is the narrowest, and these roll paper guides 26 and 27 regulate the sideways position of the paper 10*a* that is advanced to the printing position B.

The roll paper guides 24 and 25 located on the upstream side of the roll paper guides 26 and 27 are disposed slightly to the outside of the roll paper guides 26 and 27 widthwise to the roll paper compartment 9 so that the gap W2 between the roll paper guides 24 and 25 is greater than gap W1.

The roll paper guides 28 and 29 located on the upstream side of the roll paper guides 24 and 25 are disposed slightly to the outside of the roll paper guides 24 and 25 widthwise to the roll paper compartment 9 so that the gap W3 between the roll paper guides 28 and 29 is greater than gap W2.

By advancing the paper 10*a* from between the roll paper guides 28 and 29 with the widest gap W3 therebetween passed the roll paper guides 24 and 25 disposed at a slightly smaller gap and then between the roll paper guides 26 and 27 disposed with the narrowest gap W1, the paper 10*a* can be smoothly positioned laterally to the transportation path and the paper 10*a* can thus be fed to the printing position B while being positioned widthwise.

The roll paper positioning plates 31 and 32 are located near and above the roll paper guides 28 and 29 disposed with the widest gap therebetween. The gap W4 between the roll paper positioning surfaces 31*a* and 32*a* of the roll paper positioning plates 31 and 32 is substantially the same as the narrowest gap W1. The gap W4 may also be less than gap W1 and slightly less than the width of the roll paper 10 so that the roll paper positioning plates 31 and 32 contact the ends 10*b* and 10*c* of the roll paper 10 loaded in the roll paper compartment 9.

Positioning Operation of the Roll Paper Positioning Plates

When the paper 10*a* is advanced by the platen roller 11, the roll paper 10 rotates in the direction of arrow A as the paper 10*a* is pulled off the roll. Because of the inertia of the roll paper 10, rotation and stopping of the roll cannot precisely track the advancement and stopping of the paper 10*a*, and a certain delay in roll paper 10 rotation results. More particularly, the roll paper 10 does not stop immediately when paper 10*a* transportation stops, and an excess amount of paper 10*a* is therefore pulled off the roll by the continued rotation of the roll paper 10. This tendency is particularly great when the roll paper 10 diameter is large. As this start and stop operation repeats, the leading end of the paper 10*a* at the outside circumference of the roll paper 10 unwinds and becomes slack. When there is slack paper inside the roll paper compartment 9 and paper 10*a* transportation resumes, the unwound portion of the paper 10*a* tends to shift sideways so that the paper 10*a* becomes biased to the transportation direction as indicated by imaginary line 10A in FIG. 7B.

More specifically, the outside circumference part of the roll paper 10 becomes slack and shifts widthwise to the transportation path between the roll paper guides 28 and 29 where the gap W3 is great. Because the sideways position of the leading end part of the paper 10*a* is controlled by the roll paper guides 26 and 27 where the gap W1 is narrow, the paper 10*a* may start to meander if the widthwise position shifts on the upstream end of the transportation path.

In this aspect of the invention, however, the roll paper positioning surfaces 31*a* and 32*a* of the roll paper positioning plates 31 and 32 prevent the paper 10*a* at the outside circumference part of the roll paper 10 from shifting widthwise near the roll paper guides 28 and 29 located closest to the roll paper 10 in the paper 10*a* transportation direction. If the paper 10*a* at the outside circumference of the roll paper 10 unwinds and shifts sideways, the one edge of the paper 10*a* will contact the roll paper positioning surface 31*a* or 32*a* of the roll paper positioning plate 31 or 32. If the edge of the paper 10*a* pushes the roll paper positioning plate 31 or 32 widthwise to the outside, the tension spring 37 urging the roll paper positioning plates 31 and 32 to the inside stretches and thus pulls the roll paper positioning plates 31 and 32 back to the inside again. This prevents the paper 10*a* from shifting to either side.

As a result, the paper 10*a* can be reliably prevented from meandering and the edges of the paper 10*a* can be prevented from catching on or being folded by the steps along the sides of the roll paper compartment 9, that is, at the edges of the roll paper guides 24 and 25 or the roll paper guides 26 and 27 as denoted by the dot-dash circles C and D in FIG. 7B.

The roll paper positioning plates 31 and 32 can also move widthwise to the printer 1 and are urged to the inside by the tension spring 37. When the roll paper positioning plates 31 and 32 contact the outside circumference part of the roll paper 10, the gap between the roll paper positioning plates 31 and 32 temporarily increases and the transportation load of the roll paper 10 decreases. This prevents problems caused by the transportation load of the roll paper 10 increasing, such as it becoming unable to advance the paper 10*a* with good precision.

The roll paper positioning plates 31 and 32 are also located so that they can only contact the outside circumference part at the sides 10*b* and 10*c* of the roll paper 10 in the roll paper compartment 9. As the roll paper 10 is consumed and the roll diameter decreases, the ends 10*b* and 10*c* of the roll paper 10 separate from the roll paper positioning surfaces 31*a* and 32*a*. The problem of the paper 10*a* unwinding, going slack, and shifting sideways occurs easily when the inertia of the roll paper 10 is great, that is, when the roll diameter is large such as when the diameter is approximately the diameter of an unused roll 10. This problem therefore does not occur when the outside diameter is small, such as after the roll paper 10 has been used and the outside of the roll is near the core. In addition, when the roll paper 10 has been consumed and the diameter is small, the sides of the roll will not contact the roll paper positioning surfaces 31*a* and 32*a*, which are not needed when the diameter is small, thus preventing problems caused by contact with these positioning surfaces, such as increased transportation resistance reducing the paper transportation precision. The arrangement of the invention thus enables using small roll paper positioning plates 31 and 32, reducing the required installation space and reducing the manufacturing cost.

This aspect of the invention uses a single tension spring 37 to urge the opposing roll paper positioning plates 31 and 32 together. As a result, when one roll paper positioning plate moves the other roll paper positioning plate also moves substantially the same distance in the same direction, and the distance between the plates remains substantially constant. The position of the outside circumference part of the roll paper 10 can thus be effectively prevented from shifting. The parts count is also reduced because only a single urging member is needed.

This aspect of the invention is described as setting the roll paper 10 on the bottom panel 21 of the roll paper compartment 9, but the invention can be used to the same effect when the roll paper 10 is supported on a spindle passing through the roll paper core.

The roll paper 10 must also be placed between the roll paper positioning plates 31 and 32 disposed with a narrow gap therebetween when the openable cover unit 3 is closed after loading a new roll of paper, for example. This is easily accomplished with the arrangement of the invention because the roll paper guide surfaces 31*b* and 32*b* disposed to the roll paper positioning plates 31 and 32 guide the roll paper between the roll paper positioning plates 31 and 32, thus preventing such problems as the roll paper 10 being stopped by the roll paper positioning plates 31 and 32 so that the openable cover unit 3 cannot be closed smoothly.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper printer comprising;

a roll paper compartment in which a paper roll having opposite ends is mounted;

a first and a second positioning member with each disposed at a position to contact or oppose an outer circumferential part of a respective one of the two opposite ends of the paper roll;

an urging member arranged to urge the first and the second positioning member towards each other and towards the opposite ends of the paper roll; and a plurality of roll paper guides arranged in pairs to form the opposite sides of the roll paper compartment with each pair separated by a gap wherein the gap between the roll paper guides of each pair is wider than that of the next following pair in the rotary direction of the roll paper.

2. The roll paper printer described in claim 1, wherein:

the urging member is a tension spring connected between the first and the second positioning member.

3. The roll paper printer described in claim 1, wherein:

the first and the second positioning member each have a roll paper guide surface for guiding the roll paper.

4. The roll paper printer described in claim 1, wherein:

the roll paper compartment is arranged to hold the roll paper on the bottom of the roll paper compartment.

5. The roll paper printer described in claim 1, wherein:

the first and the second positioning member are disposed movably widthwise to the roll paper compartment.

6. The roll paper printer described in claim 5, wherein:

the first and the second positioning member are pivotally mounted on support pins for symmetrical movement widthwise to the printer from the opposite sides of the roll paper compartment.

7. The roll paper printer described in claim 1, further comprising:

a cover for opening and closing a roll paper loading opening to the roll paper compartment;

wherein the urging member and the first and the second positioning member are disposed to the cover.

8. The roll paper printer described in claim 1, wherein:

the first and the second positioning member are located beside the roll paper guide pair that is farthest from a printing position when seen in the direction of roll paper rotation.

9. A roll paper printer comprising:

a roll paper compartment in which a paper roll having opposite ends is mounted;

a first and a second positioning member with each disposed at a position to contact or oppose an outer circumferential part of a respective one of the two opposite ends of the paper roll; and an urging member arranged to urge the first and the second positioning member towards each other and towards the opposite ends of the paper roll; wherein:

the first and the second positioning member are located at a position that is separated from the paper roll when the diameter of the paper roll becomes small more than a maximum diameter of the paper roll that can be accommodated in the roll paper compartment.

10. The roll paper printer described in claim 9, wherein:

the urging member is a tension spring connected between the first and the second positioning member.

11. The roll paper printer described in claim 9, wherein:

the first and the second positioning member each have a roll paper guide surface for guiding the roll paper.

12. The roll paper printer described in claim 9, wherein:

the roll paper compartment is arranged to hold the roll paper on the bottom of the roll paper compartment.

13. The roil paper printer described in claim 9, wherein:

the first and the second positioning member are disposed movably widthwise to the roll paper compartment.

* * * * *

UNITED STATES PATENT AND TRADEMARK OFFICE

CERTIFICATE OF CORRECTION

PATENT NO. : 7,753,606 B2
APPLICATION NO. : 11/807844
DATED : July 13, 2010
INVENTOR(S) : Hironori Maekawa It is certified that error appears in the above-identified patent and that said Letters Patent is hereby corrected as shown below:

Title page item (56) References Cited:

Please insert --JP 2005-306535 11/2005--.

Column 10,

Line 61, please change "roil paper" to --roll paper--.

Signed and Sealed this
Fourteenth Day of June, 2011

David J. Kappos

David J. Kappos
*Director of the United States Patent and Trademark Office*